US008006604B2

(12) United States Patent
Camp

(10) Patent No.: US 8,006,604 B2
(45) Date of Patent: Aug. 30, 2011

(54) BALLISTIC RESISTANT GUN CASE AND METHOD OF USAGE

(75) Inventor: Steven A. Camp, Addison, IL (US)

(73) Assignee: Safe Direction, LLC, Addison, IL (US)

( * ) Notice: Subject to any disclaimer, the term of this patent is extended or adjusted under 35 U.S.C. 154(b) by 962 days.

(21) Appl. No.: 11/110,064

(22) Filed: Apr. 20, 2005

(65) Prior Publication Data

US 2005/0257678 A1 Nov. 24, 2005

Related U.S. Application Data

(60) Provisional application No. 60/563,769, filed on Apr. 20, 2004.

(51) Int. Cl.
*F41H 5/00* (2006.01)

(52) U.S. Cl. ..... 89/36.01; 42/106; 206/317; 224/913; 224/914

(58) Field of Classification Search ..... 89/36.01, 89/36.02; 42/106; 206/317; 224/912, 913
See application file for complete search history.

(56) References Cited

U.S. PATENT DOCUMENTS 3,762,345 A * 10/1973 Sgariglia, Jr. ..... 109/22
4,145,487 A * 3/1979 Behme et al. ..... 521/117
4,316,286 A * 2/1982 Klein ..... 2/2.5
4,475,247 A * 10/1984 Lee ..... 2/2.5
4,546,863 A * 10/1985 Kaufman ..... 190/102
4,877,131 A * 10/1989 Patros et al. ..... 206/317
5,149,203 A * 9/1992 Sacks ..... 383/111
5,329,636 A * 7/1994 Siddle ..... 2/463
5,366,105 A * 11/1994 Kerman et al. ..... 220/62.11
D358,255 S * 5/1995 Sharp et al. ..... D3/262
5,505,355 A * 4/1996 Williams ..... 224/681
5,829,586 A * 11/1998 Mermell ..... 206/317
6,000,347 A * 12/1999 Madden, Jr. ..... 109/49.5
6,161,738 A * 12/2000 Norris ..... 224/153

OTHER PUBLICATIONS

Airsoft Gun Outlet Store. http://www.airbullseye.com/P_71.htm. Date: Jul. 21, 2003 using WayBackMachine (www.waybackmachine.org). 1 Page.*
Lambretta Bags. http://www.l-n-products.co.uk/productssimple3.html. Date: Dec. 12, 2003 using WayBackMachine (www.waybackmachine.org). 1 Page.*

* cited by examiner

*Primary Examiner* — Michael Carone
*Assistant Examiner* — Jonathan C Weber
(74) *Attorney, Agent, or Firm* — Leydig, Voit & Mayer, Ltd.

(57) ABSTRACT

A gun case that facilitates safe handling of a gun to be contained therein. The gun case includes a pair of side walls with at least one of the side walls being formed with a ballistic resistant layer and one of the side walls being formed with a target indicia on an outer side thereof. During handling of the gun, the gun muzzle is held in close proximity to and pointed toward the target indicia such that an accidentally discharged bullet from the gun during handling will impact the ballistic resistant layer to prevent or minimize bodily injury or property damage.

6 Claims, 6 Drawing Sheets

BALLISTIC RESISTANT GUN CASE AND METHOD OF USAGE

FIELD OF THE INVENTION

The present invention relates generally to gun cases, and more particularly, to a gun case that facilitates safe handling of the gun even during unintentional discharge, such as occurring during loading, unloading, chamber checks and dry firing.

BACKGROUND OF THE INVENTION

Many people, such as law enforcement officers, handle and transport guns, and particularly handguns, on a daily basis. Law enforcement officers routinely load, unload, check firing chambers, and dry fire handguns, particularly before and after placing the gun into a transport or storage gun case. Surprisingly, during such handling, due to distraction or inattentiveness, it is not uncommon for a handgun to unintentional discharge, causing substantial property damage and grave danger to surrounding personnel. In a police station locker room, for example, numerous police officers can be in the immediate vicinity. An errant round can penetrate several layers of metal lockers, pass through a wall, and injure persons even in an adjacent room. Even though law enforcement officers are well trained, heretofore, safety instructions, warnings and cautioning signs have done little to alleviate the problem of unintentional handgun discharge.

OBJECTS AND SUMMARY OF THE INVENTION

It is an object of the present invention to provide a gun storage and transport case that facilitates safe handling of handguns and the like, such as during loading, unloading, chamber checks, and dry firing.

Another object is to provide a gun case as characterized above which substantially reduces the likelihood of property damage, personal injury, or death from unintentional discharged rounds during handling of the gun.

A further object is to provide a gun case of the above kind which continually reminds and dictates safe handling of the gun after removal from the case.

Yet another object to provide a handgun case of the foregoing type which is adapted to absorb and contain an errant round discharged from a handgun during handling of the gun.

Still another is to provide a method of using such a handgun case during loading, unloading, and other routine handling of the gun which prevents property damage and injury from unintentional discharge of the gun.

Other objects and advantages of the invention will become apparent upon reading the following detailed description and upon reference to the drawings, in which:

Figure 1:
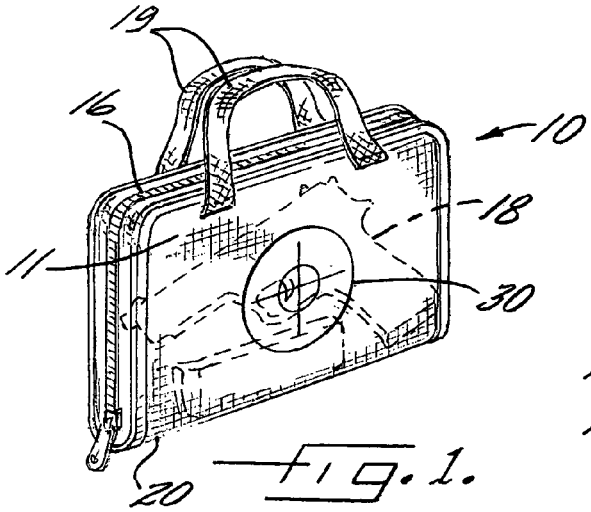
FIG. 1 is a perspective of an illustrative soft sided gun case in accordance with the invention.
Figure 2:
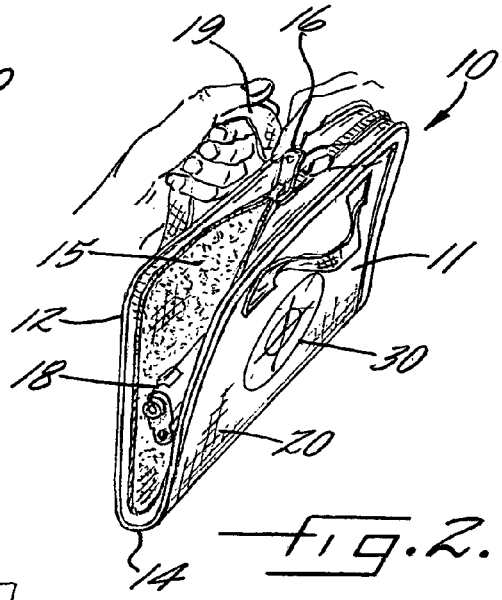
FIG. 2 is a perspective of the gun case shown in FIG. 1, being opened to obtain access to a handgun contained therein.
Figure 3:
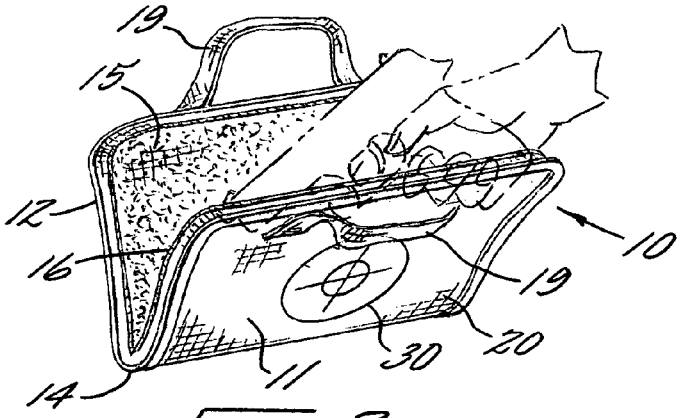
FIG. 3 is a perspective of the illustrative gun case showing the handgun being removed therefrom.

While the invention is susceptible of various modifications and alternative constructions, certain illustrated embodiments thereof have been shown in the drawings and will be described below in detail. It should be understood, however that there is no intention to limit the invention to the specific forms disclosed, but on the contrary, the intention is to cover all modifications, alternative constructions and equivalents failing within the spirit and scope of the invention.

DETAILED DESCRIPTION OF PREFERRED EMBODIMENTS

Referring now more particularly to FIGS. 1-6 of the drawings, there is shown an illustrative handgun storage and carrying case 10 in accordance with the invention. The illustrated handgun case 10 includes front and rear sidewall panels 11, 12 which are foldable about a bottom junction area 14 to define a gun receiving compartment 15. A releasable fastener in the form of a zipper 16 is provided for securing the side panels 11, 12 together to contain a gun 18 therein. The side panels 11, 12 each have a respective handle 19 fixed along a respective upper end thereof to facilitate carrying of the gun case 10.

In accordance with an important aspect of the invention, at least one of the side panels comprises a ballistic resistant layer which is adapted to impede and/or contain an errant round directed into the gun case should an unintentional discharge of the gun occur during handling of the gun following removal from the case. More particularly, the gun case may include a bullet penetration resistant layer which prevents penetration and passage of a bullet through the material and/or a bullet force diffusing layer which spreads out the impact energy of an entering bullet over a greater area for preventing blunt trauma injury or property damage on a side of the gun case opposite to that which is struck by the errant round. In an illustrative embodiment, the gun case 10 has a soft construction which includes an outer fabric cover 20 of flexible material which extends continuously about and defines the outer face of the front and rear side panels 11, 12.

Figure 6:
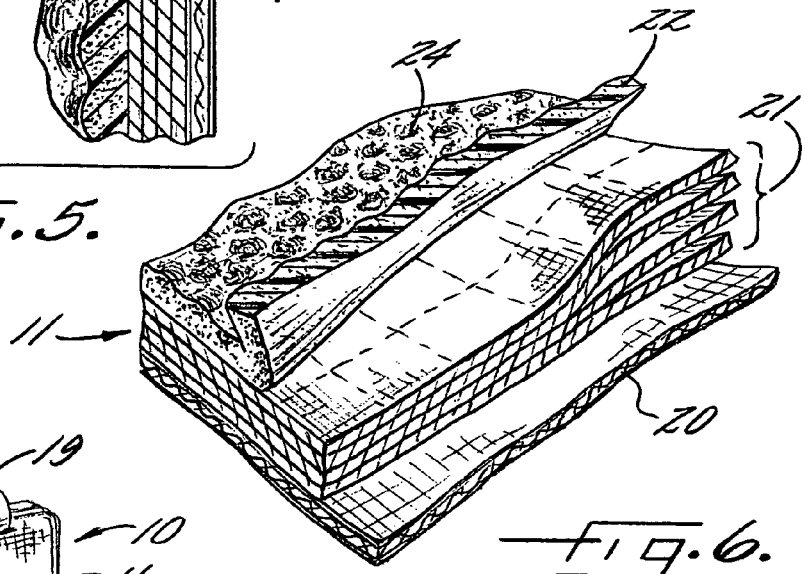
FIG. 6 is an enlarged partially exploded section of the front sidewall panel of the illustrated gun case.

In carrying out the invention, the front panel 11 in this instance includes a bullet penetration resistant layer 21 which may be made of a material commercially available from DuPont Corporation under the name Kevlar. This layer 21 preferably comprises a plurality of individual adjacent layers of Kevlar material, as illustrated in FIG. 6. As is known in the art, Kevlar is a fabric material designed to resist penetration and passage of traveling bullets. The number of layers of Kevlar can be designed for the caliber of bullet for which the composite layer 21 is to resist passage. In the illustrated embodiment, adjacent an inner side of the bullet penetration resistant layer 21, a cushioning layer is provided in the form of a foam layer 22 and an inner padding layer 24 that defines a soft interior side of the side panel.

While Kevlar is known for resisting the penetration and passage of bullets, the bullet nevertheless can continue to have significant impact force on the side of the layer opposite that to which the bullet enters, commonly referred to as impact trauma force. Hence, items immediately adjacent the rear side of the Kevlar layer can be exposed to significant impact trauma and damage.

In further keeping with the invention, in the illustrated embodiment, the rear side panel 12 includes a bullet force diffusing layer 25 effective for substantially diffusing and spreading out the impact trauma force of a bullet to prevent or substantially minimize harmful impact trauma effects on items adjacent the outer side of the rear side panel 12. The bullet force diffusing layer 25 may be made of a polyurethane material, such as is commercially available from Gallagher Corporation, Gurnee, Ill., under the designation GC 493. The bullet force diffusing layer 25 preferably takes the form of a single layer of such polyurethane compound that can be molded, poured, or injected into a suitable flexible plate-like form between about ⅛" and ½" in thickness. Such material has characteristics that diffuse and spread out impact energy from a bullet so as to reduce the impact trauma thereof on a side opposite that which is impacted by the bullet. The rear side panel 12 in the case also has an inner cushioning layer comprising a foam layer 22 and a padding 21, similar to the front panel 11, for providing a soft gun receiving compartment between the front and rear side panels 11, 12.

For purposes herein the term "bullet penetration resistant layer" shall mean a layer of material that resists penetration and passage of a fired bullet while not necessarily preventing blunt force trauma or impact due to deformation. The term "bullet force diffusing layer" shall mean a layer of material that diffuses and dampens the impact of force of a fired bullet by distributing the force over a larger area, while not necessarily preventing or substantially resisting penetration and passage of the bullet. The term "ballistic resistant layer" shall mean a layer which comprises either a bullet penetration resistant layer or a bullet force diffusing layer.

An example of a bullet penetration resistant layer, as indicated above, is a material commercially available from DuPont Corporation under the name Kevlar. Kevlar is one member of a family of synthetic fibers known as aramid (i.e., aromatic polyamide) fibers. Aramid fibers comprise long molecular chains in which a substantial portion (e.g., at least about 85%) of the amide groups of the molecular chain are directly attached to two aromatic groups. Para-aramid fibers are a subset of aramid fibers, which subset includes Kevlar, in which a substantial portion of the amide groups of the molecular chain are attached to the aromatic groups of the molecular chain at the 1 and 4 positions (i.e., the aromatic groups are para substituted). Chemically, Kevlar is an organic fiber comprising highly-orientated, long molecular chains of poly(1,4-phenyleneterephthalamide). As noted above, when Kevlar is used as the bullet resistant layer, the individual Kevlar fibers have been woven together to produce a fabric material. While the bullet penetration resistant layer has been described herein with respect to Kevlar, those of ordinary skill in the art will readily appreciate that the bullet penetration resistant layer can be made from other suitable materials including, but not limited to, woven materials made from other aramid or para-aramid fibers (i.e., aramid or para-aramid fibers other than Kevlar) or woven materials made from a combination of two or more aramid fibers.

An example of a bullet force diffusing layer is a layer of polyurethane material, as indicated above, commercially available material from Gallagher Corporation under the designation GC 493. GC 493 is a castable thermoset polyester-based MDI polyurethane (i.e., polyester-based methylene diphenyl diisocyanate polyurethane). GC 493 exhibits a relatively high resistance to indentation when tested according to the Shore A and Shore D tests. In particular, GC 493 exhibits a Shore A hardness of greater than about 90 (e.g., about 93) and a Shore D hardness of greater than about 45 (e.g., about 49). GC 493's tensile properties also contribute to its usefulness as a bullet diffusing layer. For example, GC 493 exhibits a Tensile Modulus at 100% Elongation of about 2000 psi (13.9 MPa), a Tensile Modulus at 300% Elongation of about 3900 psi (26.9 MPa), an Ultimate Tensile Strength of 7500 psi (51.8 MPa), and an Ultimate Elongation of 450%. While the bullet force diffusing layer has been described herein with respect to GC 493, those of ordinary skill in the art will appreciate that the bullet force diffusing layer can be made from any suitable material (e.g., polyolefin-based or polyurethane-based material) having mechanical properties similar to those exhibited by GC 493. Such materials tend to dampen and substantially spread out the impact force of a bullet striking the layer, so as to prevent or substantially reduce the pressure of the force on the side of the material opposite that to which the bullet enters. While these materials do not substantially prevent penetration and passage of the bullet, the materials have been found to be self-closing so as to contain and encapsulate the bullet, or a fragment of bullets which impact the material.

In keeping with a further important aspect of the invention, the outer side of the front side panel 11 bears an indicia in the form of a target emblem 30 which facilitates and encourages safe handling of the gun after removal from the gun case, or following unloading or chamber checking. The emblem 30 in this case is in the form of a target centrally located on the outer side surface of the front gun case panel 11. It will be understood by one skilled in the art that such emblem may be appropriately printed or otherwise formed on or affixed to the outer surface of the front panel.

Figure 4:
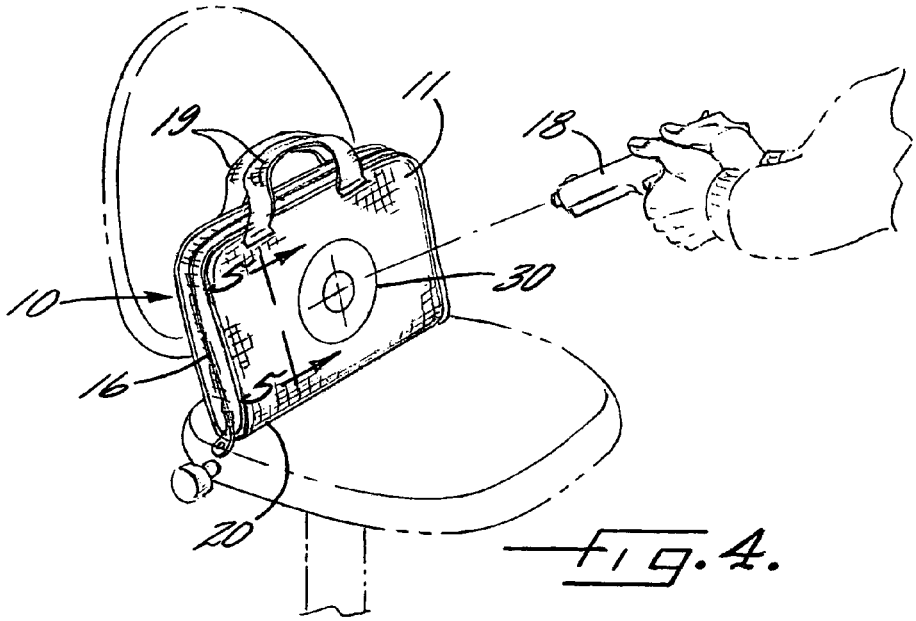
FIG. 4 is a perspective of the illustrative gun case, showing safe handling usage of the gun with the illustrated gun case, such as either before or after removal of the gun from the case, following a chamber check or during a dry firing test.
Figure 5:
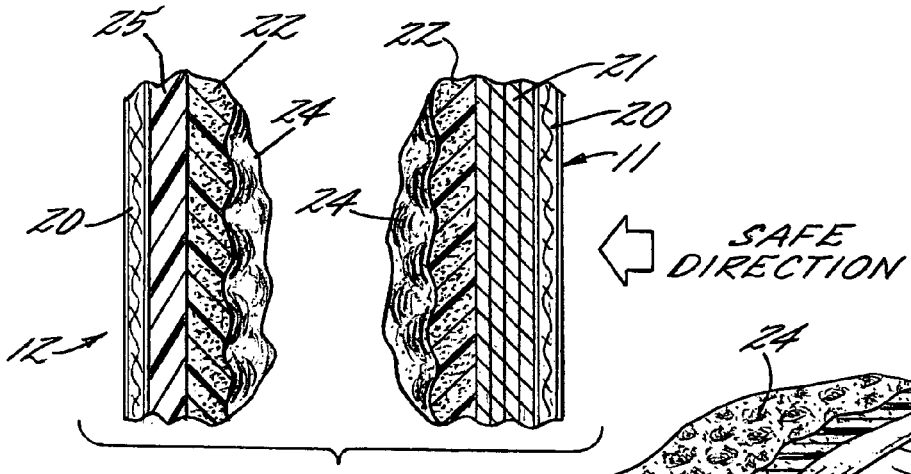
FIG. 5 is an enlarged fragmentary section of the sidewall panels or of the illustrated gun case, taken in the plane of line 5-5 in FIG. 4.
Figure 7:
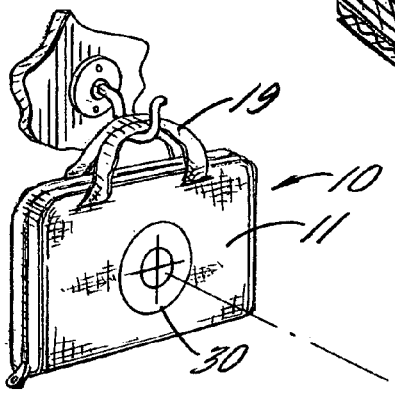
FIG. 7 is a perspective of an alternative manner in which the illustrated gun case may be supported during handling of the gun.

In using the gun case 10 in accordance with the method of the present invention, upon removal of a handgun 18 from the case, the case 10 may be re-closed by use of the zipper 16. The gun case 10 is then positioned onto a stable surface such as a chair as depicted in FIG. 4, or alternatively, hung from a wall hanger or the like, as depicted in FIG. 7. With the emblem 30 facing outwardly, the gun may be then held with the muzzle directed at the center of the target emblem 30, preferably 16" inches away or closer. The handgun muzzle may be continuously pointed at the emblem, at a perpendicular angle the front panel 11, during the entire handling operation, which may be loading, unloading, chamber checking, or dry firing practice. In the event the gun is accidentally discharged during such handling, it will be seen that the gun case 10 will absorb and contain the errant round without danger to surrounding personnel or property damage. More particularly, the bullet penetration resistant layer 21 will prevent penetration and passage of a bullet through the gun case, while the bullet force diffusing layer 25 will minimize impact trauma forces which could otherwise damage the furniture or wall against which the gun case is supported. With the target emblem 30 on the outside of the gun case, the user is constantly reminded of the necessary safe handling procedure.

Figure 8:
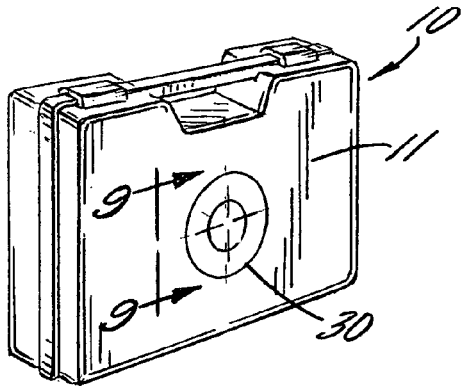
FIG. 8 is a perspective of an alternative hard sided embodiment of a gun case in accordance with the invention.
Figure 9:
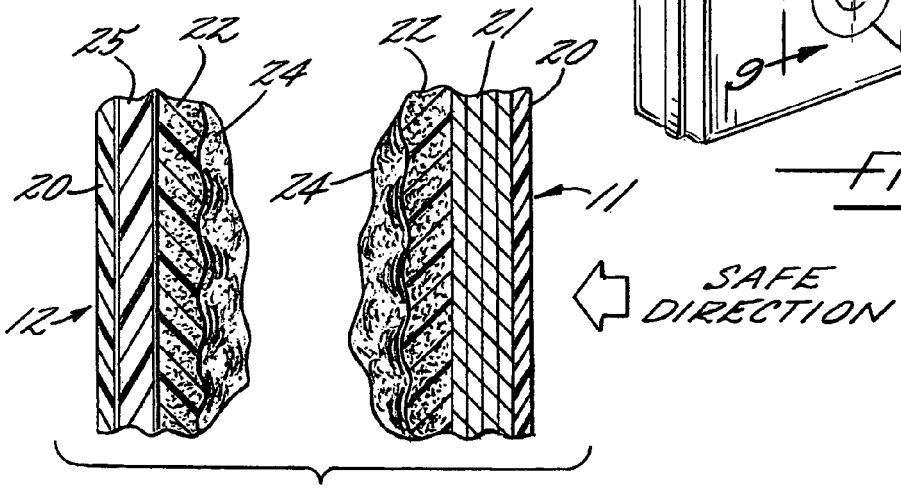
FIG. 9 is an enlarged fragmentary section of the sidewall panels of the gun case shown in FIG. 8, taken in the plane of line 9-9.
Figure 10:
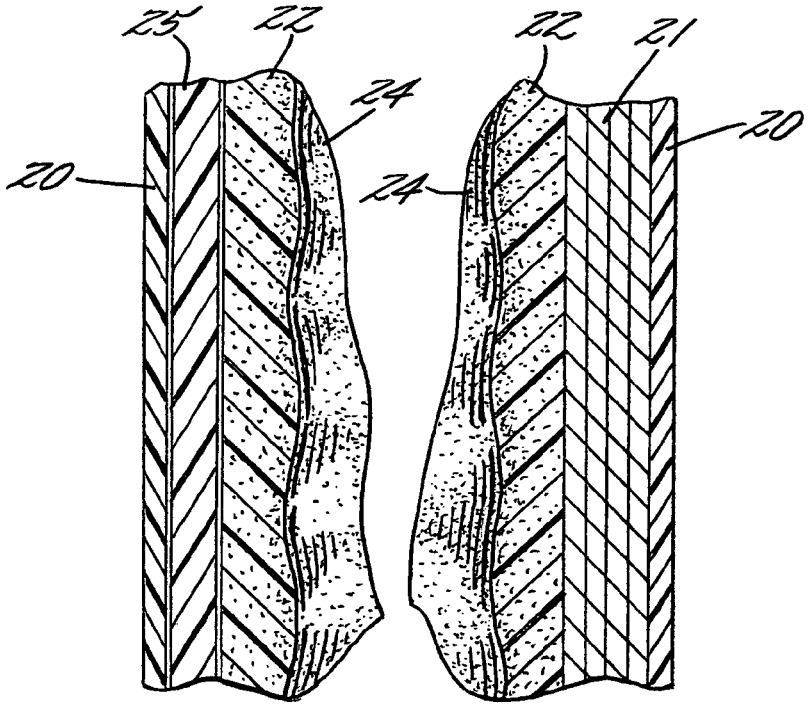
FIGS. 10-16 disclose various alternative wall constructions for gun cases and in accordance with the invention.
Figure 11:
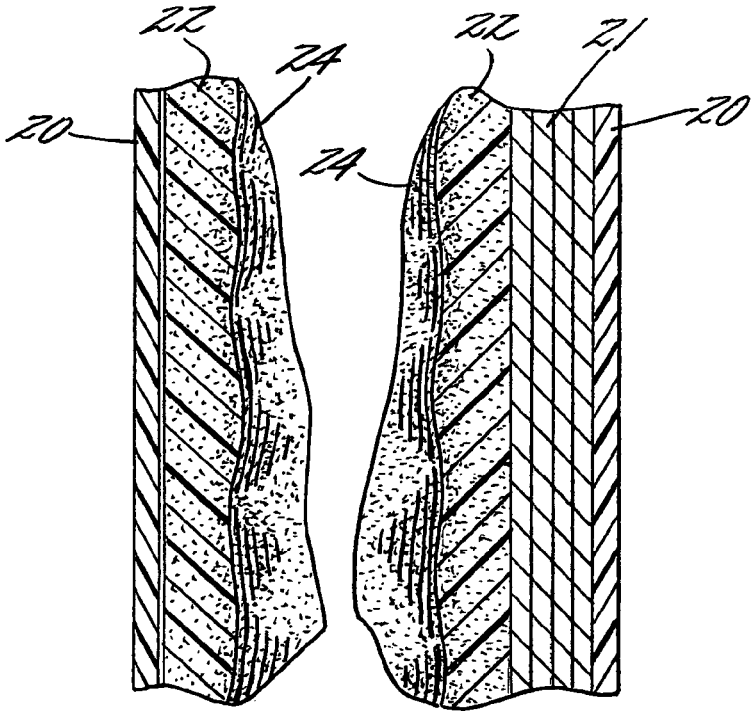

FIGS. 8 and 9 disclose a hard-sided alternative embodiment of the gun case in accordance with the invention, wherein items similar to those described above have been given several reference numerals. In this case, the outer shell or cover 20 of the gun case is made of a form retaining hard construction, such as plastic.

Figure 12:
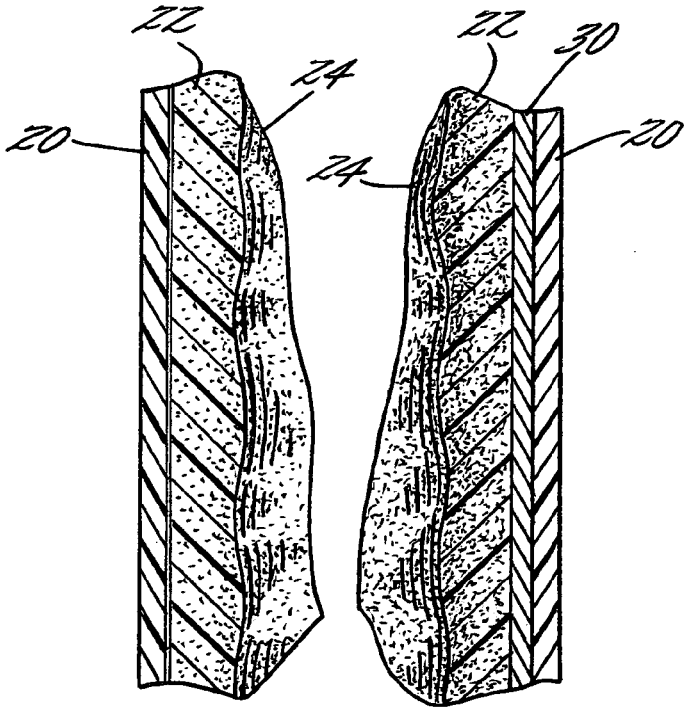
Figure 13:
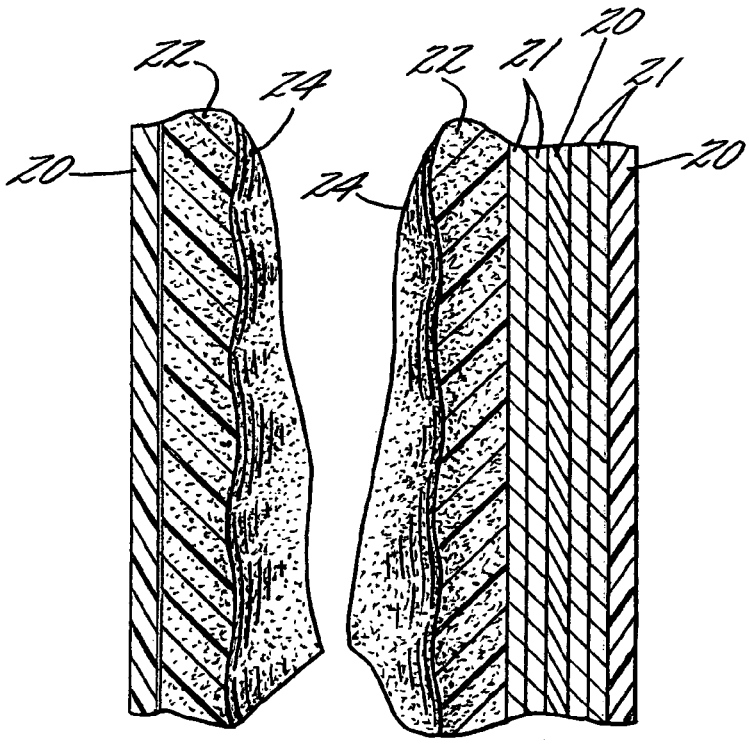
Figure 14:
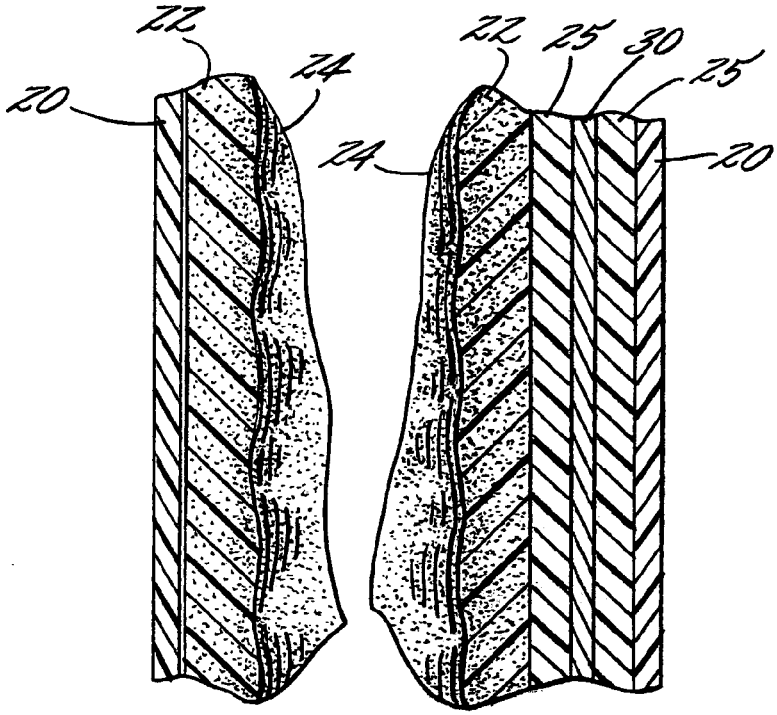
Figure 15:
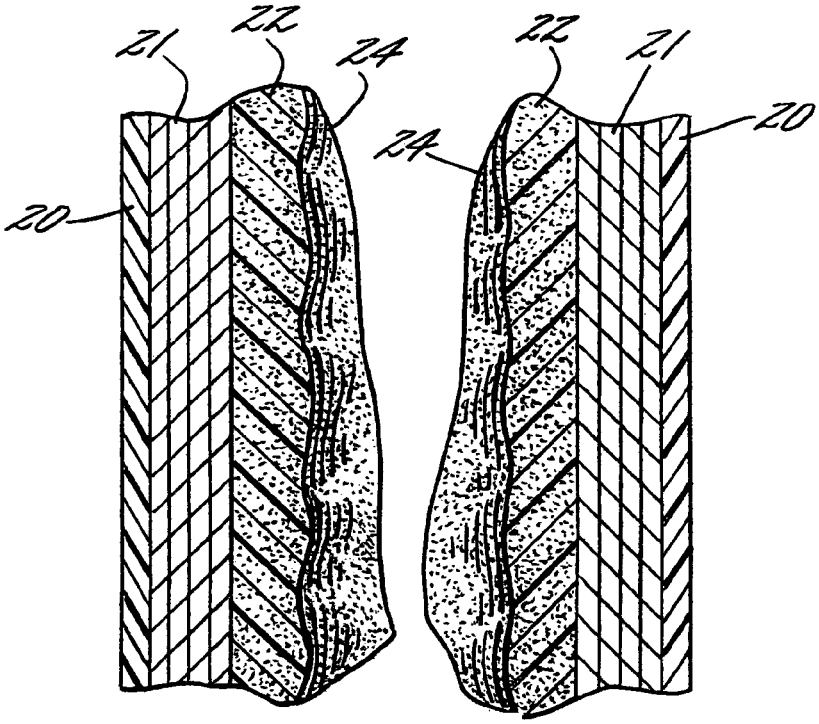
Figure 16:
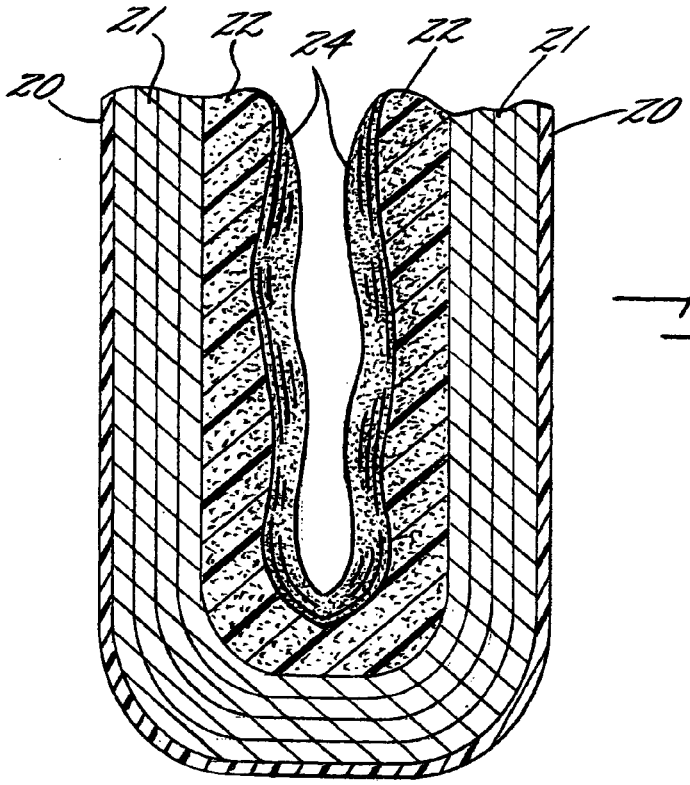

FIGS. 10-16 disclose alternative panel constructions for gun cases in accordance with the invention, wherein items similar to those described above have again been given similar reference numerals. As depicted in FIGS. 12-14, the gun case may also have an integrated metal armor plate 30 in one of the side wall panels. In the embodiment of FIG. 14, the armor plate 30 is sandwiched between force diffusing layers 25. The bullet force diffusing layer 25 on the rear side of the armor plate 30 will diffuse impact trauma forces of the by the armor plate, while the bullet force diffusing layer 25 on the front side of the armor plate unexpectedly has been found to contain and capsulate fragments of the bullet that may result from striking the armor plate.

Figure 17:
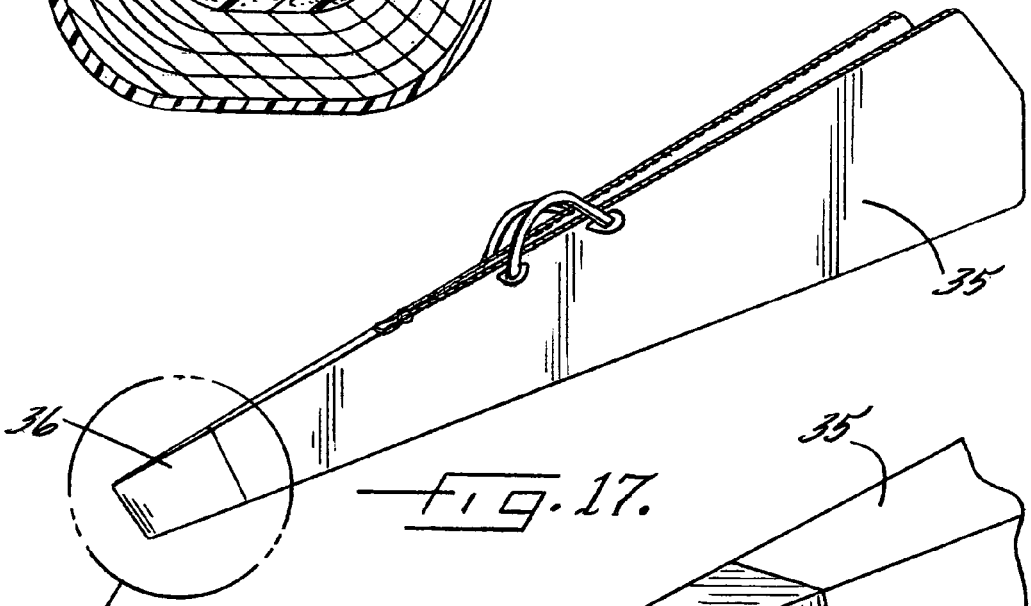
FIG. 17 is a long gun case having a muzzle end adapted for protecting against unintentional discharge of a contained gun.
Figure 17A:
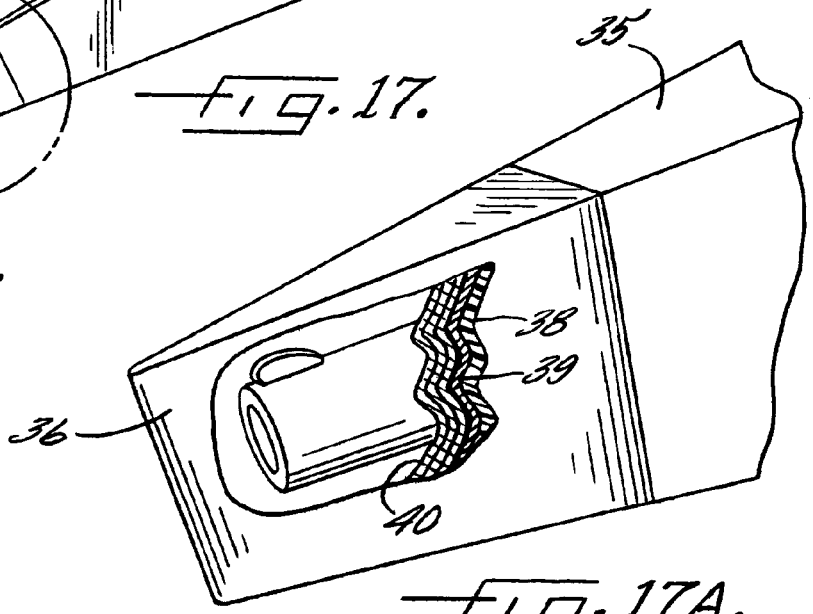

With reference to FIG. 17, a gun case 35 is shown for a long gun, such as a shotgun. In keeping with this embodiment of the invention, the gun case 35 has a composite nozzle construction which contains an accidental discharge of a gun contained within the case. The gun case nozzle 36 in this case comprises an outer shell 38, an armor plate 39, and a ballistic resistant panel 40 which may be in the form of a bullet penetration resistant layer, a forced diffusing layer panel, or both.

While the gun case 20 preferably is supported in its closed position when handling of the gun as described above, it will be appreciated that alternatively the gun case may be supported in an open position, such as being laid on the floor or hung on a wall with the front end rear panels 11, 12, forming a protective mat. In such case, the panel 11 upon which the target emblem 30 is positioned may be formed with both a bullet penetration resistant layer and a force diffusing layer of material. Likewise, the invention may be applicable to a target mat of such construction.

The invention claimed is:

1. A method of handling a gun in conjunction with a gun case having a pair of side panels that define a compartment for storing the gun during non-usage with at least one of said side panels being formed with a ballistic resistant layer and one of said panels having a target indicia located on an outer side thereof comprising the steps of:

positioning the gun case with the indicia facing outwardly toward the user, handling the gun by loading, unloading, chamber checking, or dry firing practice, and during the handling step pointing and maintaining the gun at the indicia on the gun case such that an accidentally discharged bullet from the gun during handling will impact the gun case and the ballistic resistant material in the side wall thereof.

2. The method claim 1 including positioning the gun case by hanging the gun case on the wall with the target indicia facing outwardly to the user.

3. The method claim 1 including positioning the gun case by placing it on a stable surface.

4. The method claim 1 including pointing the gun at the indicia while the gun is located no greater than 16 inches away from the gun case.

5. The method claim 4 including pointing the gun by holding a muzzle thereof in substantially perpendicular relation to side target indicia.

6. A method of handling a gun in conjunction with a gun case having a pair of side panels that define a compartment for storing the gun during non-usage with at least one side panel being formed with a bullet penetration resistant layer and having a target indicia located on an outer side thereof comprising the steps of:

positioning the gun case with the indicia facing forward toward the user, handling the gun by loading, unloading, chamber checking, or dry firing practice, and during the handling step pointing and maintaining the gun at the indicia on the gun case such that an accidentally discharged bullet from the gun during handling will impact the gun case and the bullet penetration resistant layer of the side panel.

* * * * *